US009841137B1

(12) United States Patent
Pierce

(10) Patent No.: US 9,841,137 B1
(45) Date of Patent: Dec. 12, 2017

(54) STABILIZER PAD

(71) Applicant: Keith W. Pierce, Portland, MI (US)

(72) Inventor: Keith W. Pierce, Portland, MI (US)

( * ) Notice: Subject to any disclaimer, the term of this patent is extended or adjusted under 35 U.S.C. 154(b) by 0 days.

(21) Appl. No.: 15/082,801

(22) Filed: Mar. 28, 2016

Related U.S. Application Data

(60) Provisional application No. 62/138,419, filed on Mar. 26, 2015.

(51) Int. Cl.
*F16M 13/00* (2006.01)
*B65D 21/02* (2006.01)

(52) U.S. Cl.
CPC ..... *F16M 13/00* (2013.01); *B65D 21/0209* (2013.01)

(58) Field of Classification Search
CPC .... F16M 2200/08; F16M 11/22; F16M 13/00; F16M 11/10; F16M 11/041; F16M 13/02; F16M 5/00; F16M 11/08; F16M 13/022; F16M 11/24; F16M 11/2014; F16M 11/18; F16M 11/2021; F16M 11/42; F16M 7/00
USPC ..... 248/346.01, 633, 634, 910
See application file for complete search history.

(56) References Cited

U.S. PATENT DOCUMENTS

| | | | | |
|---|---|---|---|---|
| 5,442,882 | A | 8/1995 | Repasky | |
| 6,332,292 | B1 | 12/2001 | Buzon | |
| 6,604,330 | B2 | 8/2003 | Repasky | |
| 7,386,955 | B1 | 6/2008 | Repasky | |
| 7,654,501 | B2 * | 2/2010 | Matthews | E04H 6/426 116/28 R |
| 7,780,140 | B1 * | 8/2010 | Ward | E02D 27/44 248/678 |
| 8,381,461 | B2 | 2/2013 | Repasky | |
| 8,776,452 | B1 | 7/2014 | DeJonge | |
| 9,016,653 | B1 * | 4/2015 | Cox, Jr. | B65D 19/0002 248/346.01 |
| 2009/0302185 | A1 * | 12/2009 | Rowland | F16M 11/22 248/346.2 |
| 2010/0207004 | A1 * | 8/2010 | Hermans | B65D 19/0002 248/346.01 |
| 2011/0147558 | A1 * | 6/2011 | Marquardt | F16M 11/36 248/346.2 |
| 2012/0168592 | A1 | 7/2012 | Jones | |
| 2013/0232891 | A1 | 9/2013 | Ferguson | |

* cited by examiner

*Primary Examiner* — Steven Marsh
(74) *Attorney, Agent, or Firm* — Robert C. Montgomery; Montgomery Patent & Design, L.P.

(57) ABSTRACT

A stabilizer pad includes a generally square shape with an interior area having a geometry adapted to removably secure objects having either matching geometrical bases. The pad is capable of stacking upon an identically shaped pad.

20 Claims, 2 Drawing Sheets

STABILIZER PAD

RELATED APPLICATIONS

The present invention is a continuation-in-part of, was first described in, and claims the benefit of U.S. Provisional Application No. 62/138,419, filed Mar. 26, 2015, the entire disclosures of which are incorporated herein by reference.

FIELD OF THE INVENTION

The present invention relates generally to a stabilizer pad having interiors to removably secure objects having matching appendages.

BACKGROUND OF THE INVENTION

There are a great many products used around homes and businesses in an outdoor environment. These objects include everything from tables and chairs, ladders, planters, portable awnings, to heavier objects such as support jacks used for recreational vehicles and the like. Unfortunately, when such objects are placed on soft ground surfaces such as grass or even asphalt, they are not level and/or sink into the ground immediately or over time. Many resort to the use of blocks of wood to help level, stabilize, and to prevent sinking. It is quickly realized that these blocks of wood are often too thick, too thin, or not wide enough. This causes the blocks to slip, slide, and create even more problems than they were intended to solve. Accordingly, there exists a need for a means by which various types of door objects can be supported, leveled, and stabilized in order to prevent problems as described. The development of the stabilizer pad fulfills this need.

SUMMARY OF THE INVENTION

It is therefore an object of the present invention to provide a stabilizing pad system, including at least one (1) first generally square resilient body, each having a planar first side, a planar second side, and a first recessed area located within a first interior rib upstanding from the first side. The system also includes least one (1) second square resilient body, each having a planar third side, a planar fourth side, a first perimeter rib disposed about a perimeter of the third side, a second recessed area located between a second interior rib upstanding from the third side and the first perimeter rib, a second perimeter rib disposed about a perimeter of the fourth side, and a third recessed area located between a third interior rib upstanding from the fourth side and the second perimeter rib. The first interior rib is capable of stacking with either the second or third interior rib. The first recessed area is capable of receiving and supporting a portion of a piece of weighted object therein. Some embodiments also include a fourth recessed area located within a fourth interior rib upstanding from the second side. wherein said plurality of notches are capable of removably receiving said fourth interior rib therein of another first body. The fourth interior rib is capable of stacking with either the second or third interior rib. The fourth recessed area is also capable of receiving and supporting a portion of a piece of weighted object therein.

Another object of the present invention is to provide for the first interior rib or fourth rib of the first body to be generally circular.

Another object of the present invention is to provide for the first interior rib to be generally rectangular. In certain embodiment, the first interior rib further has a plurality of notches. Such plurality of notches is shaped to be capable of removably retaining the circular shape of the first or fourth interior rib. Some embodiments include a second plurality of notches shaped to be capable of removably retaining the rectangular shape of the first interior rib.

Another object of the second body it to have the second interior rib to include a first center portion located on a center of the third side, and a first plurality of linear portions, each radiating outward from the first center portion to the first perimeter rib. Similarly, the third interior rib further includes a second center portion located on a center of the fourth side, and a second plurality of linear portions, each radiating outward from the second center portion to the second perimeter rib. In certain embodiments, the first plurality of linear portions includes a plurality of notches, each capable of removably receiving either the first or fourth interior rib from the first body. The first plurality of linear portions can also include another plurality of notches, each capable of removably receiving either first or fourth interior rib from the first body. Similarly, the second plurality of linear portions can include a plurality of notches, each capable of removably receiving either first or fourth interior rib from said first body. The second plurality of linear portions can also include another plurality of notches, each capable of removably receiving either first or fourth interior rib from the first body.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
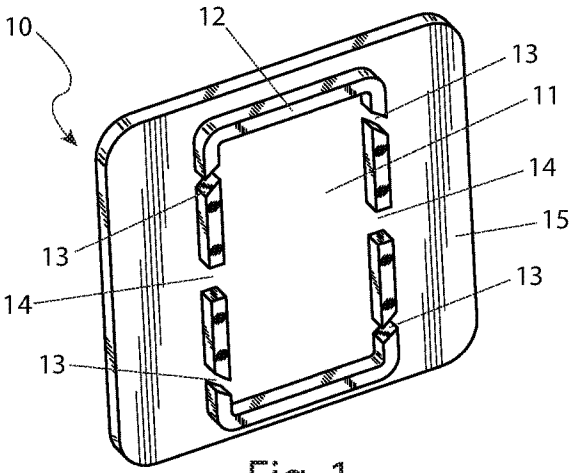
FIG. 1 is a front perspective view of a first embodiment 10 of a stabilizer pad, according to a preferred embodiment of the present invention.

10 first embodiment
11 first embodiment first recessed area
12 first embodiment first side interior rib
13 first embodiment arcuate notch
14 first embodiment center notch

15 first embodiment first side
16 first embodiment second recessed area
17 first embodiment second side
18 first embodiment second side interior rib
20 second embodiment
21 second embodiment recessed area
22 second embodiment interior rib
23 second embodiment arcuate notch
24 second embodiment center notch
25 second embodiment first side
27 second embodiment second side
30 third embodiment
31 third embodiment first recessed area
32*a* third embodiment first side interior rib
32*b* third embodiment second side interior rib
33*a* third embodiment first side first notch
33*b* third embodiment first side second notch
34 third embodiment first side perimeter rib
35 third embodiment first side
36 third embodiment second recessed area
37 third embodiment second side
38*a* third embodiment second side first notch
38*b* third embodiment second side second notch
39 third embodiment second side perimeter rib
40 fourth embodiment
41 fourth embodiment recessed area
42 fourth embodiment interior rib
45 fourth embodiment first side
47 fourth embodiment second side

DETAILED DESCRIPTION OF THE PREFERRED EMBODIMENT

Figure 2:
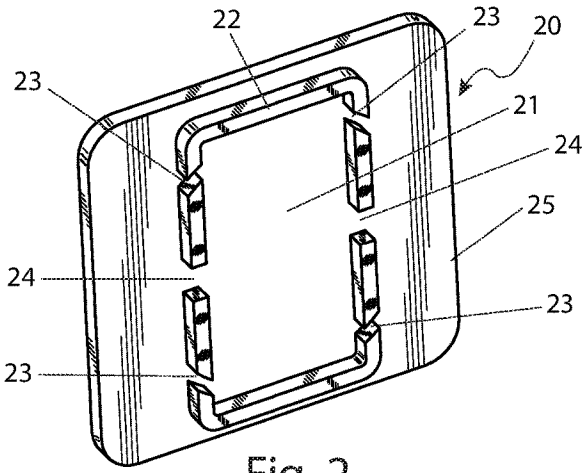
FIG. 2 is a front perspective view of a second embodiment 20 of a stabilizer pad, according to an alternate embodiment of the present invention.
Figure 3:
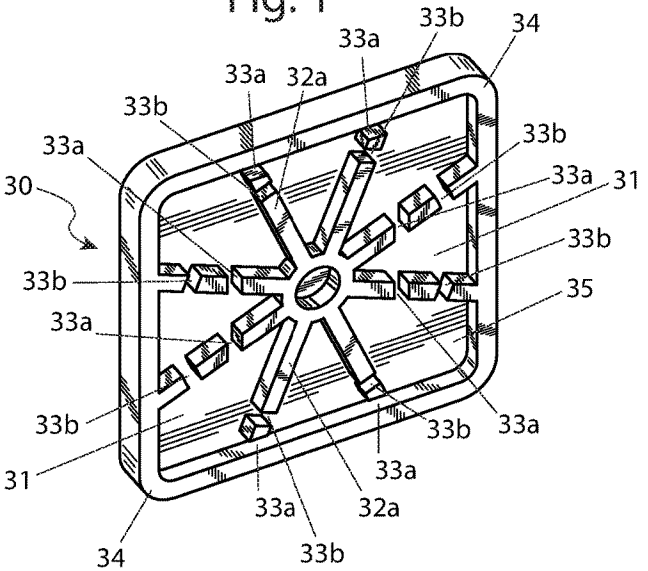
FIG. 3 is a front perspective view of a third embodiment 30 of a stabilizer pad, according to an alternate embodiment of the present invention.

The best mode for carrying out the invention is presented in terms of its preferred embodiment, herein depicted within FIGS. 1 through 3. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope.

The terms "a" and "an" herein do not denote a limitation of quantity, but rather denote the presence of at least one (1) of the referenced items.

The stabilizer pad, as its name implies, is a set of interlocking pads available in multiple embodiments 10, 20, 30, 40 used to support, level, and spread the weight impact of concentrated loads in an outdoor environment. The first embodiment 10, second embodiment 10, and fourth embodiment 40 are each capable of being placed under and protecting legs of an object, the third embodiment 30 is capable of enabling stacking of adjacent ones of either the first embodiment 10, second embodiment 20, or fourth embodiment 40.

Referring now to FIGS. 1, 2, 4-6, and 8, each of the first embodiment 10, second embodiment 20, and fourth embodiment 40 is capable of being placed under various objects or legs of objects. The pads 10, 20, 40 may vary in size according to need; however an average size pad is envisioned to be a generally square shape with rounded corners and sized approximately twelve square inches (12 $in^2$). Each pad 10, 20, 40 would vary in thickness from one-quarter inch (¼ in.) up to one inch (1 in.) or more. The first side 15, 25, 45, of the first embodiment 10, second embodiment 20, and fourth embodiment 40 is provided either with a circular or rectangular center recessed area 11, 21, 41 to hold the original object or leg of the object. The recessed area 11, 21, 41 is provided with additional interlocking segments such as interior support ribs 12, 22, 42 that complement the perimeter of the object it is supporting. These support ribs 12, 22, 42 can be provided with inner locking anti-rotation tabs. Each pad 10, 20, 40 would be used on objects such as chairs, tables, ladders, portable awnings, trailer jacks, and the like. The user can adjust the height of the object or level individual parameters of the object by placing at least one (1) pad 10, 20, 40 under the object. It is possible to also include the third embodiment 30 in order to stack multiple embodiments 10, 20, 30, 40 together to achieve the desired height. While originally viewed as a method to obtain a desired height or level an object, it may also be used to protect products from ground contact and to prevent any point of load objects from sinking into the ground.

Figure 4:
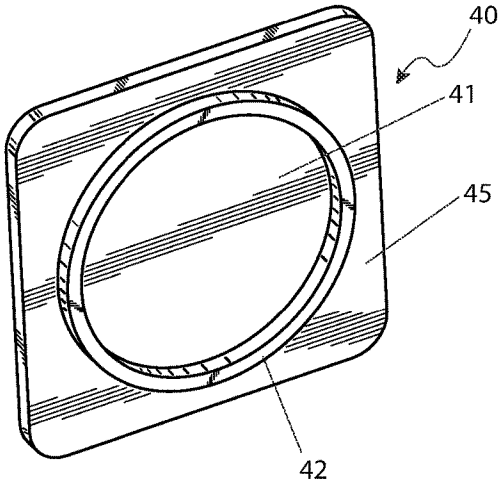
FIG. 4 is a front perspective view of a fourth embodiment 40 of a stabilizer pad, according to an alternate embodiment of the present invention.
Figure 5:
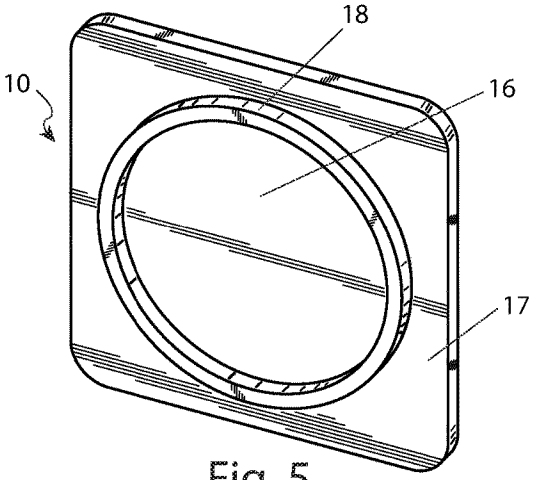
FIG. 5 is a rear perspective view of a first embodiment 10 of a stabilizer pad, according to a preferred embodiment of the present invention.

Referring now to FIGS. 4 and 5 the fourth embodiment first side 45 and the first embodiment second side 17 each has a recessed area 41, 16 in the shape of a circle. Both the fourth embodiment first side 41 and the first embodiment second side 17 has respective fourth embodiment interior rib 42 a first embodiment second interior rib 18 also in the general shape of a circle. The fourth embodiment interior rib 42 and first embodiment second interior rib 18 are continuous.

Referring now to FIGS. 1 and 2, the first embodiment first side 15 and second embodiment first side 25 each have interior support ribs 12, 22 that are discontinuously in the form of a rectangle. The sides with the shorter length are continuous. The sides with the greater length has aligned center notches 14, 24. Adjacent the ends of the side with the greater length are arcuate notches 13, 23 corresponding to the circular shape of the fourth embodiment interior rib 42 and first embodiment second interior rib 18. As such, this enables the fourth embodiment first side 45 to have a friction fit nesting stacking arrangement with either the first embodiment first side 15 or second embodiment first side 25. Similarly, the first embodiment second side 17 also can enjoy a friction fit nesting stacking arrangement with either another first embodiment first side 15 or a second embodiment first side 25.

Figure 6:
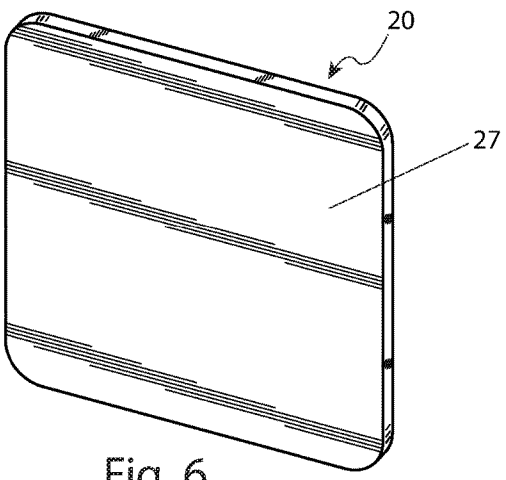
FIG. 6 is a rear perspective view of a second embodiment 20 of a stabilizer pad, according to an alternate embodiment of the present invention.
Figure 8:
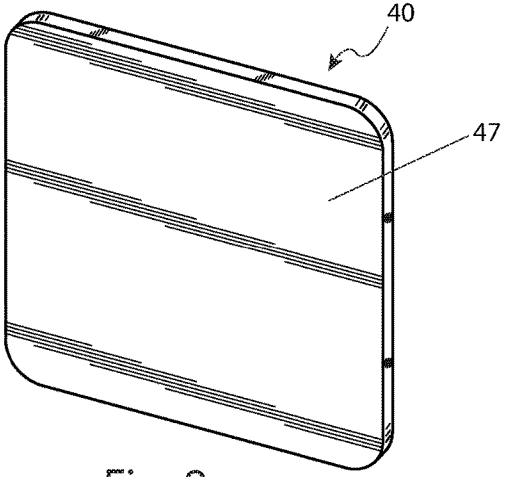

Referring now to FIGS. 6 and 8, the second embodiment second side 27 and the fourth embodiment second 47 are each planar and have no ribs.

Figure 7:
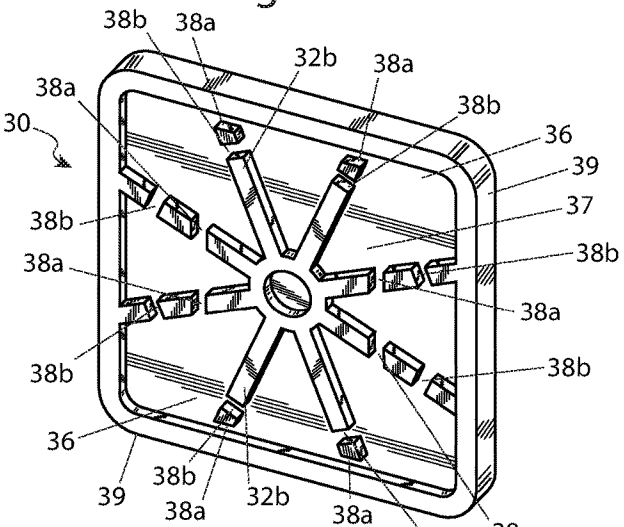
FIG. 7 is a rear perspective view of a third embodiment 30 of a stabilizer pad, according to an alternate embodiment of the present invention; and, FIG. 8 is a rear perspective view of a fourth embodiment 40 of a stabilizer pad, according to an alternate embodiment of the present invention.

Referring now to FIGS. 3 and 7, the third embodiment 30 has a general shape similar to that of the first embodiment 10, second embodiment 20, and fourth embodiment 40, although it is thicker. The third embodiment has a first side 35 and second side 37 having identical features. The third embodiment 30 is capable of employing friction fit nesting stacking arrangements of either the first embodiment 10, second embodiment 20, or fourth embodiment 40 on either the third embodiment first side 35 or third embodiment second side 37. The third embodiment first side perimeter rib 34 is continuously disposed about the perimeter of the third embodiment first side 35. Similarly, the third embodiment second side perimeter rib 39 is continuously disposed about the perimeter of the third embodiment second side 37. The third embodiment first interior rib 32*a* is fashioned as a continuous small circular portion centered on the third embodiment first side 35 and a plurality of discontinuous radiating ribs connecting to the third embodiment first side perimeter rib 34. Similarly, the third embodiment second interior rib 32*b* is fashioned as a continuous small circular portion centered on the third embodiment second side 37 and a plurality of discontinuous radiating ribs connecting to the third embodiment second side perimeter rib 39. In a preferred embodiment, the number of radiating ribs are eight (8) and they are equidistantly spaced from each other. The third embodiment first recessed area 31 corresponds to all the area between the third embodiment first side perimeter rib 34 and third embodiment first side interior ribs 32*a*, whereas the third embodiment second recessed area 36 corresponds to all the area between the third embodiment second side perimeter rib 39 and third embodiment second side interior ribs 32*b*.

Similar to the first embodiment and second embodiment interior ribs 12, 42, the third embodiment 30 has a plurality of notches 33*a*, 33*b*, 38*a*, 38*b* to enable the friction fit nesting stacking arrangement between either side 35, 37 of the third embodiment 30 with the circular shape of the interior rib 42, 18 of the first embodiment second side 17 or fourth embodiment first side 45, or the rectangular shape of the interior rib 12, 22 of the first embodiment first side 15 or second embodiment first side 25. The plurality of radiating ribs on the third embodiment first side 35 has a plurality of third embodiment first side first notches 33*a* aligned in an arrangement capable of receiving in a friction fit nesting stacking arrangement of the rectangular shape of the first embodiment first side interior rib 12 and second embodiment interior rib 22. Similarly, the plurality of radiating ribs on the third embodiment second side 37 has a plurality of third embodiment second side first notches 38*a* aligned in an arrangement capable of receiving in a friction fit nesting stacking arrangement of the rectangular shape of the first embodiment first side interior rib 12 and second embodiment interior rib 22. The plurality of radiating ribs on the third embodiment first side 35 has a plurality of third embodiment first side second notches 33*b* aligned in an arrangement capable of receiving in a friction fit nesting stacking arrangement of the circular shape of the first embodiment second side interior rib 12 and fourth embodiment interior rib 42. Similarly, the plurality of radiating ribs on the third embodiment second side 37 has a plurality of third embodiment first side second notches 38*b* aligned in an arrangement capable of receiving in a friction fit nesting stacking arrangement of the circular shape of the first embodiment second side interior rib 12 and fourth embodiment interior rib 42.

The use of each pad 10, 20, 30, 40 provides a means to stabilize and level outdoor objects in a manner which is quick, easy, and effective. The materials required to produce each stabilizer pad 10, 20, 30, 40 are all readily available and well known to manufacturers of goods of this type. Each of the pads 10, 20, 30, 40 would be made of high density, ultraviolet (UV) resistant plastic in an injection molding process. Such a process would require the design and use of custom molds. The raw materials as used in each pad 10, 20, 30, 40 would best be obtained from wholesalers and manufacturers that deal in goods of that nature and assembled at a final location. The relatively simple design of each pad 10, 20, 30, 40 and the material of construction make it a cost-effective design due to the relatively low material and labor costs involved. Final production of each pad 10, 20, 30, 40 will be performed by manufacturing workers of average skill.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A stabilizer pad, comprising:

a generally square resilient body, having a planar first side and a planar second side; and, a recessed area located within a generally rectangular interior rib upstanding from said first side;

wherein said interior rib further comprises a plurality of notches;

wherein said interior rib is capable of stacking with a second interior rib of a second stabilizer pad; and, wherein said recessed area is capable of receiving and supporting a portion of a piece of weighted object therein.

2. The stabilizer pad of claim 1, wherein said interior rib is generally circular.

3. The stabilizer pad of claim 1, further comprising a second recessed area located within a second interior rib upstanding from said second side;

wherein said plurality of notches are capable of removably receiving said second interior rib therein of another stabilizer pad.

4. The stabilizer pad of claim 3, wherein said second interior rib is generally circular.

5. A stabilizer pad, comprising:

a generally square resilient body, having a planar first side and a planar second side;

a first perimeter rib disposed about a perimeter of said first side;

a first recessed area located between a first interior rib upstanding from said first side and said first perimeter rib;

a second perimeter rib disposed about a perimeter of said second side; and, a second recessed area located between a second interior rib upstanding from said second side and said second perimeter rib;

wherein:

said first interior rib further comprises:

a first center portion located on a center of said first side; and, a first plurality of linear portions, each radiating outward from said first center portion to said first perimeter rib, and, said second interior rib further comprises:

a second center portion located on a center of said second side; and, a second plurality of linear portions, each radiating outward from said second center portion to said second perimeter rib; and, wherein said first plurality of linear portions comprises a plurality of notches, each capable of removably receiving a circular interior rib from another stabilizer pad.

6. The stabilizer pad of claim 5, wherein said first plurality of linear portions comprises a second plurality of notches, each capable of removably receiving a rectangular interior rib from yet another stabilizer pad.

7. The stabilizer pad of claim 5, wherein said second plurality of linear portions comprises a plurality of notches, each capable of removably receiving a circular interior rib from another stabilizer pad.

8. The stabilizer pad of claim 7, wherein said second plurality of linear portions comprises a second plurality of notches, each capable of removably receiving a rectangular interior rib from another stabilizer pad.

9. The stabilizer pad of claim 6, wherein said second plurality of linear portions comprises a third plurality of notches, each capable of removably receiving a circular interior rib from a third stabilizer pad.

10. The stabilizer pad of claim 9, wherein said second plurality of linear portions comprises a fourth plurality of notches, each capable of removably receiving a circular interior rib from a fourth stabilizer pad.

11. A stabilizing pad system, comprising:

at least one first generally square resilient body, each comprising:

a planar first side and a planar second side; and, a first recessed area located within a first interior rib upstanding from said first side; and, at least one second square resilient body, each comprising:

a planar third side and a planar fourth side;

a first perimeter rib disposed about a perimeter of said third side;

a second recessed area located between a second interior rib upstanding from said third side and said first perimeter rib;

a second perimeter rib disposed about a perimeter of said fourth side; and, a third recessed area located between a third interior rib upstanding from said fourth side and said second perimeter rib;

wherein said first interior rib further comprises a plurality of notches;

wherein said first interior rib is capable of stacking within either said second interior rib or said third interior rib; and, wherein said first recessed area is capable of receiving and supporting a portion of a piece of weighted object therein.

12. The system of claim 11, wherein said first interior rib is generally circular.

13. The system of claim 11, wherein said first interior rib is generally rectangular.

14. The system of claim 11, further comprising a fourth recessed area located within a fourth interior rib upstanding from said second side;

wherein said plurality of notches are capable of removably receiving said fourth interior rib therein of another first body; and, wherein said fourth interior rib is capable of stacking within either said second interior rib or said third interior rib.

15. The system of claim 14, wherein said fourth interior rib is generally circular.

16. The system of claim 14, wherein:

said second interior rib further comprises:

a first center portion located on a center of said third side; and, a first plurality of linear portions, each radiating outward from said first center portion to said first perimeter rib, and, said third interior rib further comprises:

a second center portion located on a center of said fourth side; and, a second plurality of linear portions, each radiating outward from said second center portion to said second perimeter rib.

17. The stabilizer pad of claim 16, wherein said first plurality of linear portions comprises a second plurality of notches, each capable of removably receiving either said first or fourth interior rib from said first body.

18. The stabilizer pad of claim 17, wherein said first plurality of linear portions comprises a third plurality of notches, each capable of removably receiving either said first or fourth interior rib from said first body.

19. The stabilizer pad of claim 18, wherein said second plurality of linear portions comprises a fourth plurality of notches, each capable of removably receiving either said first or fourth interior rib from said first body.

20. The stabilizer pad of claim 19, wherein said second plurality of linear portions comprises a fifth plurality of notches, each capable of removably receiving either said first or fourth interior rib from said first body.

* * * * *